United States Patent [19]

Rizley

[11] Patent Number: 4,938,722

[45] Date of Patent: Jul. 3, 1990

[54] FISHERMAN'S FLOAT PROPELLING SYSTEM

[76] Inventor: Harold K. Rizley, P.O. Box 720, Sayre, Okla. 73662

[21] Appl. No.: 372,791

[22] Filed: Jun. 29, 1989

[51] Int. Cl.[5] ..... B63H 7/08; B63H 21/17

[52] U.S. Cl. ..... 440/6; 114/351; 441/131

[58] Field of Search ..... 114/315, 351; 441/109, 441/129, 130, 131, 132; 440/6

[56] References Cited

U.S. PATENT DOCUMENTS

| | | | |
|---|---|---|---|
| 2,958,876 | 11/1960 | Garrett | 441/131 |
| 3,324,488 | 6/1967 | Schulz, Jr. | 9/1 |
| 3,441,952 | 4/1969 | Strader | 440/6 |
| 3,635,188 | 1/1972 | Rutrowski | 440/6 |
| 3,935,607 | 2/1976 | Cantwell et al. | 114/345 |
| 4,700,654 | 10/1987 | Borges | 440/6 X |

*Primary Examiner*—Sherman Basinger

*Attorney, Agent, or Firm*—Robert K. Rhea

[57] ABSTRACT

In a fisherman's float propelling system, a trolling motor is mounted on a panel adapted to be secured to the calf portion of a user's leg so that, with the fisherman's leg extended horizontally forwardly, the longitudinal axis of the motor is disposed substantially parallel with the surface of a body of water. The motor is energized and its propeller moves the fisherman, his float and a battery supporting auxiliary float to a selected location.

4 Claims, 1 Drawing Sheet

FISHERMAN'S FLOAT PROPELLING SYSTEM

BACKGROUND OF THE INVENTION

1. Field of the invention.

This invention relates to fishing floats and more particularly to apparatus for propelling the float and fisherman in a desired direction.

Pneumatic tubes supporting a fabric forming a seat commonly referred to as a "fishing float" are well known. These floats, when used by a fisherman, are usually propelled by manual effort of the fisherman's legs having fins attached to his feet. Constantly moving about in a body of water results in tiring the fisherman.

It is, therefore, desirable that an economical powered form of propulsion be provided to increase the enjoyment of float fishing.

2. Description of the prior art.

The most pertinent prior patent is believed to be United States Pat. No. 3,324,488 which discloses a steerable trolling motor attached to a peripheral portion of a custom made fishing float by a motor mounting transom.

This invention is distinctive over this patent by utilizing any pneumatic fishing float which does not require modification of the fishing float or a custom made float.

SUMMARY OF THE INVENTION

A commercially available trolling motor is secured to one flat surface of an elongated panel, intermediate the ends thereof, extending between the knee and ankle position of a fisherman rearwardly of his calf, the panel being strapped to the fisherman's leg. An auxiliary buoyant member is connected in trailer fashion to the fishing float and supports a container housing, a source of electrical energy and/or other fishing supplies. An electrical circuit connects the source of electrical energy with the trolling motor through an off/on switch temporarily secured to an upper surface of the fishing float. With the fisherman seated in the fishing float and the trolling motor attached to one of his legs, the fisherman extends that leg in a horizontal forward direction to position the longitudinal axis of the motor substantially parallel with the surface of a body of water in which the fishing float is located Energizing the motor for rotating its propeller moves the fisherman and the float across the body of water with the direction of movement being controlled by the radial position of the trolling motor mounted leg relative to the vertical axis through the fishing float. Except when moving to another fishing location the fisherman's leg is relaxed and hangs downwardly from the knee.

The principal object of this invention is to provide a float fishing propelling system which may be used with any conventional fishing float, without modification thereof, comprising relatively few and inexpensive components and when operated may be oriented in any desired direction for moving the fisherman and float across water while leaving both hands free for operating fishing rods, or the like.

DESCRIPTION OF THE PREFERRED EMBODIMENTS

Figures 1, 2:
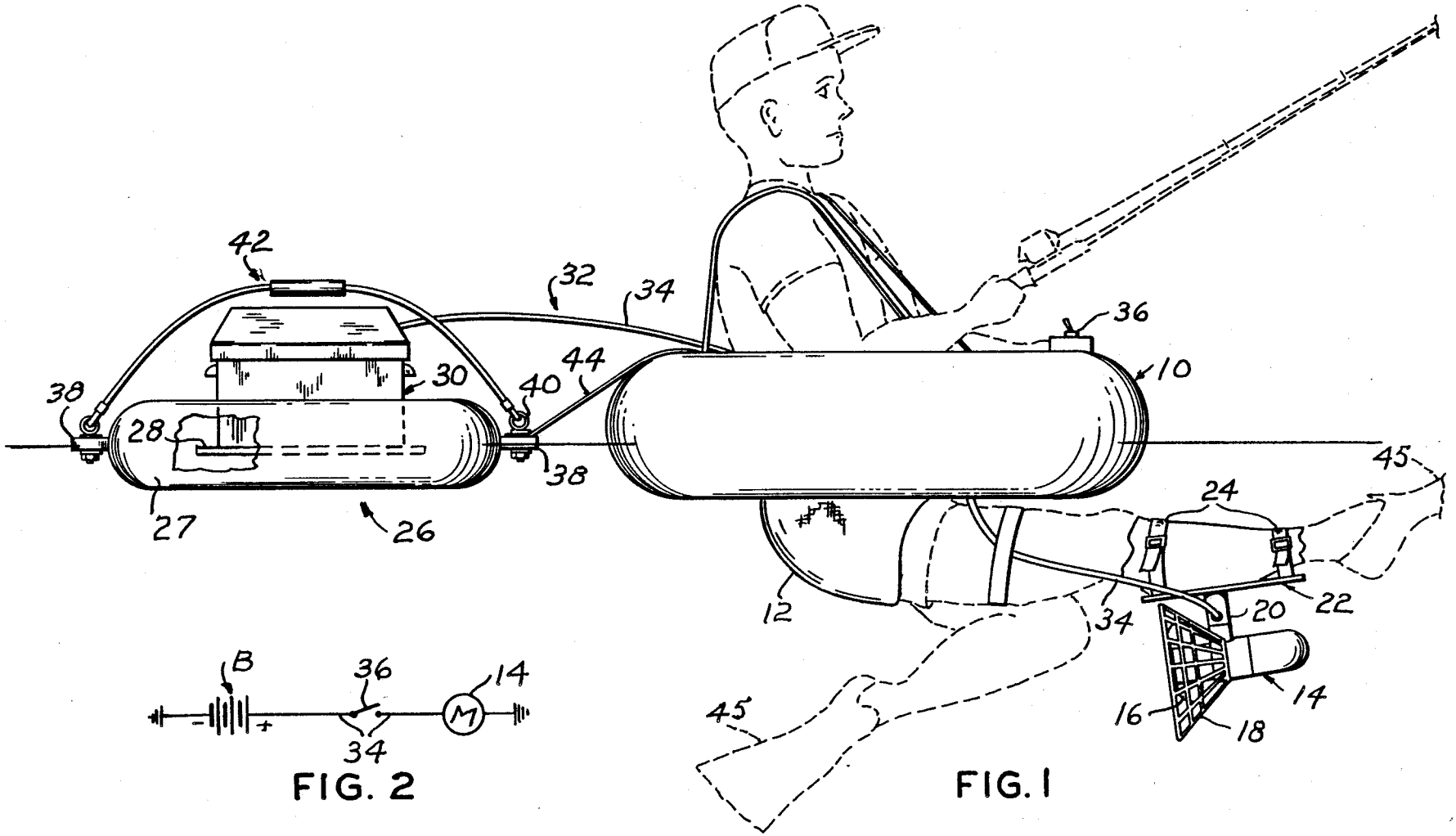
FIG. 1 is a side elevational view illustrating the relative position of a fisherman when the trolling motor is in an operation position; and, FIG. 2 is a wiring diagram.

Like characters of reference designate like parts in those figures of the drawings in which they occur.

In the drawings:

The reference numeral 10 indicates a conventional pneumatic tube dimensioned to loosely surround and buoyantly support a fisherman when seated on seat forming fabric 12 attached to and supported by the tube 10. The numeral 14 indicates a conventional trolling motor having a propeller 16 at one end which is surrounded by a conical-shaped guard or cage 18. The body of the motor is provided with a lateral tube-like extension 20 normal to the longitudinal axis of the body which is secured to one flat surface of an elongated planar panel 22 intermediate its ends. The length of the panel is not greater than the distance between a fisherman's knee and ankle position and the width of the panel is substantially equal to the diameter of the fisherman's leg.

A pair of buckle equipped straps 24, attached to respective end portions of the panel 22, encircle a fisherman's leg at approximately the upper and lower limits, respectively, of his calf with the panel disposed rearwardly of his calf, in the example shown.

The numeral 26 indicates a second or an auxiliary float means which may be a pneumatic tube or a pair of substantially cylindrical buoyant members 27, only one being shown, horizontally disposed in parallel side-by-side spaced-apart relation and interconnected by a horizontal panel 28 forming a platform or floor for a container 30. The container 30 may be a Styrofoam picnic-type case or formed from other material, as desired.

A battery B is housed by the container 30 and connected with the trolling motor 14 by a circuit 32. The circuit comprises wiring 34 having a normally open off/on switch 36 interposed therein, the switch being preferably temporarily secured to the upper surface of the fishing float 10 forwardly of the position of a fisherman when seated therein.

The auxiliary float 26 is provided with forward and rearward lug-type extensions 38 for receiving eye-bolts 40 and respective end portions of a handle member 42 for convenience in launching and retrieving the float 26 as a unit. One of the lugs 38 is connected with one end of a tow strap 44 connected in trailer tongue fashion at its other end with the fisherman's float or the seat forming fabric 12.

OPERATION

In operation, the apparatus is assembled, as described hereinabove with the fisherman preferably wearing frog fins 45. When the fisherman desires to move to another location he extends his leg, with the attached motor, horizontally in a direction toward the position that he desires to move to and turns the manual switch 36 to the "on" position for energizing the motor 14. The motor propeller moves the fisherman, his float tube and the auxiliary float 26 to the new location with the direction of movement aided, in part, by the fins 45 wherein the fin on the fisherman's other foot acts as a rudder. Thereafter moving the switch 36 to the "off" or open position deenergizes the motor allowing the fisherman to remain in the new position until he desires to move elsewhere.

Obviously the invention is susceptible to changes or alterations without defeating its practicability. Therefore, I do not wish to be confined to the preferred embodiment shown in the drawings and described herein.

I claim:

1. In a toric fishing float dimensioned to loosely surround the torso and buoyantly support a fisherman in a sitting position, the improvement comprising: propulsion means including a trolling motor having a propeller for moving the float and fisherman across a body of water; flexible mounting means for operatively attaching said motor to the fisherman;

said mounting means including a panel having a length less than the distance between a fisherman's knee and ankle and having a width less than its length;

motor mount means securing said motor to said panel intermediate its ends with the panel and motor axes disposed in longitudinal parallel relation;

flexible means attaching respective end portions of said panel to a fisherman's leg between his knee and ankle, whereby said motor moves the float and fisherman across a body of water when the motor is energized and the fisherman positions his motor attached leg forwardly in a substantially horizontal direction; and, a source of electrical energy including an electric circuit for energizing said motor.

2. The combination according to claim 1 and further including:

an auxiliary float means having a horizontal platform attached in trailer fashion to said fishing float; and, a battery supported by said platform.

3. The combination according to claim 2 in which said auxiliary float means comprises:

a pneumatic tube.

4. The combination according to claim 2 in which said auxiliary float means comprises:

a pair of laterally spaced-apart cylindrical floats.

* * * * *